United States Patent [19]

James

[11] 4,431,052

[45] * Feb. 14, 1984

[54] DOWNHOLE SEAL FOR LOW PROFILE OIL WELL PUMPING INSTALLATIONS

[75] Inventor: Robert G. James, Whittier, Calif.

[73] Assignee: Armco Inc., Middletown, Ohio

[ * ] Notice: The portion of the term of this patent subsequent to Apr. 21, 1998 has been disclaimed.

[21] Appl. No.: 207,946

[22] Filed: Nov. 18, 1980

Related U.S. Application Data

[63] Continuation-in-part of Ser. No. 66,631, Aug. 15, 1979, Pat. No. 4,262,742.

[51] Int. Cl.[3] ..... E21B 43/00

[52] U.S. Cl. ..... 166/112; 166/105; 166/84; 166/68

[58] Field of Search ..... 166/112, 106, 107, 84, 166/68, 105

[56] References Cited

U.S. PATENT DOCUMENTS

| | | | |
|---|---|---|---|
| 1,966,917 | 7/1934 | Bracht | 285/13 |
| 2,286,300 | 6/1942 | Outcalt | 166/84 |
| 3,145,995 | 8/1964 | Adamson et al. | 166/84 X |
| 3,217,805 | 11/1965 | Howard | 166/84 X |
| 3,353,606 | 11/1967 | Dyer | 166/84 |
| 3,640,342 | 2/1972 | Gault | 166/72 |
| 4,262,742 | 4/1981 | James | 166/112 X |

*Primary Examiner*—Ernest R. Purser
*Assistant Examiner*—Thuy M. Bui
*Attorney, Agent, or Firm*—I. Michael Bak-Boychuk

[57] ABSTRACT

Set out herein is a seal arrangement for sealing an oil well rod string below ground surface. More specifically a polished cylinder is inserted into the casing of an oil well and is supported at the well head by a flange radially extending from the upper end thereof. Received in the cylinder is a piston assembly connected at the upper surface to a flexible string or chain articulated by a pump and supporting at the lower surface a polished rod sealably extending through a lower seal fitting received in the bottom end of the polished cylinder. The cavity formed between the piston and the polished cylinder is aspirated into the well casing through a one-way check valve on the upward stroke of the piston and any oil residue that may pass through the lower sealing assembly is forced back into the well casing by another check valve opened during the downward piston stroke. Both the piston and the seal assembly may include sealing rings to improve edge contact which thus render the downhole seal less vulnerable to hot gases and abrasive impurities commonly found in the course of secondary recovery.

3 Claims, 3 Drawing Figures

DOWNHOLE SEAL FOR LOW PROFILE OIL WELL PUMPING INSTALLATIONS

CROSS-REFERENCE TO RELATED APPLICATION

This application is a continuation-in-part of my copending application Ser. No. 066,631 filed Aug. 15, 1979 now U.S. Pat. No. 4,262,742 entitled "DOWNHOLE SEAL FOR LOW PROFILE OIL WELL PUMPING INSTALLATIONS."

BACKGROUND OF THE INVENTION

1. Field of the Invention

The present invention relates to oil well sealing units, and more particularly for sealing units deployable below ground to reduce pump height.

2. Description of the Prior Art

In the recent past, significant efforts have been directed to increase the economies and efficiency of oil well pumps and to reduce the physical structure thereof both for the sake of visual impact and in the interests of costs. Typically an oil well or any other well where liquids are pumped from subterrainian deposits entail long strings sucker rods which necessarily must be articulated above ground to achieve pumping. In each instance a reciprocal motion of the sucker rod is entailed and it is the length of the stroke that heretofore has yielded the best returns in economy. The longer pumping stroke, however, entails higher elevation at which the reciprocal force is applied to the rod strength or, alternatively, deeper deployments of below ground seals; the first alternative entailing large supporting structures and the second alternative demanding complex lifting mechanisms to bring the seal to the surface for periodic maintenance. Thus, for example, in U.S. Pat. No. 3,640,342 to Robert H. Gault, issued Feb. 8, 1972, a travelling stuffing box has been devised which is particularly suitable for below ground sealing. Concurrently in my patent application Ser. No. 824,346 filed Aug. 15, 1977 I have found that certain beneficial aspects can be realized by the use of non-linear arrangements for counterbalanced pumping systems which, however, lose part of the efficiency realized to the losses entailed of drawing the sucker rods through the seal packing. In addition, since secondary recovery is now widely practiced throughout the United States, exposure of the downhole seal to hot steam or abrasive particles entails a more frequent interval for seal maintenance and any techniques which extend the life of the packing or the maintenance period greatly enhance the cost effectiveness of the low profile pumps, particularly when the long stroke lifting hoists are entailed in the maintenance schedule.

Packing, while suitable for its purpose, entails intimate contact with the sucker rod over large areas and thus presents a large frictional loss in the course of pumping. Thus the benefits achieved in oscillatory pumping systems are often, at least in part, reduced by the friction of the packing. Furthermore, packing as originally envisioned is best suited for ground surface installation and is best maintained thereat. The maintenance sequences envisioned originally for packing accommodates the lack of scraping action which, in the case of well fluids carrying abrasives often results in destruction of the polished rods or other close tolerance structures.

SUMMARY OF THE INVENTION

Accordingly, it is the general purpose and object of the present invention to provide a downhole seal arrangement for a well wherein metal rings are utilized for sealing and scraping of fluid.

Further objects of the invention are to provide a downhole seal arrangement wherein the reciprocating articulation of the pump is utilized to drive the leakage fluids back into the well.

Yet further objects of the invention are to provide a downhole sealing arrangement which by virtue of its mechanical parts entailed low frictional coefficients with the pump rod.

Briefly, these and other objects are accomplished within the present invention by providing an inverted cylinder which is insertable into a well tube suspended on the interior of a well casing forming the well head at its upper end. This cylinder may be polished on the interior to provide effective sealing and is conformed to receive a piston articulated by a chain or flexible cable therein. The piston, in turn, may attach to a polished rod which extends through an annular plug in the other end of the cylinder and it is this polished rod that articulates the rod string in the well bore pump. To allow for the upward movement of the piston with the cylinder, an aspiration path is formed between the cavity confined by the piston and the annular plug, the aspiration path including a check valve which is closed on the downward part of the piston stroke. This check valve, in an aspiration path between the cylinder and the well casing allows the ingestion of air during the upward piston stroke. The annular plug, furthermore, includes another check valve biased to drain off any leaked fluid during the course of the downward stroke. Both the piston and the annular plug may include scraper and sealing rings thus further perfecting the seal, the rings, by virtue of their edge contact providing very little resistance to the reciprocal stroke. In this form the well fluid pumped during the reciprocation of the sucker rods is lifted into the annular cavity around the cylinder to be drained into a collection tank at the ground surface.

DESCRIPTION OF THE SPECIFIC EMBODIMENT

Figures 1, 2:
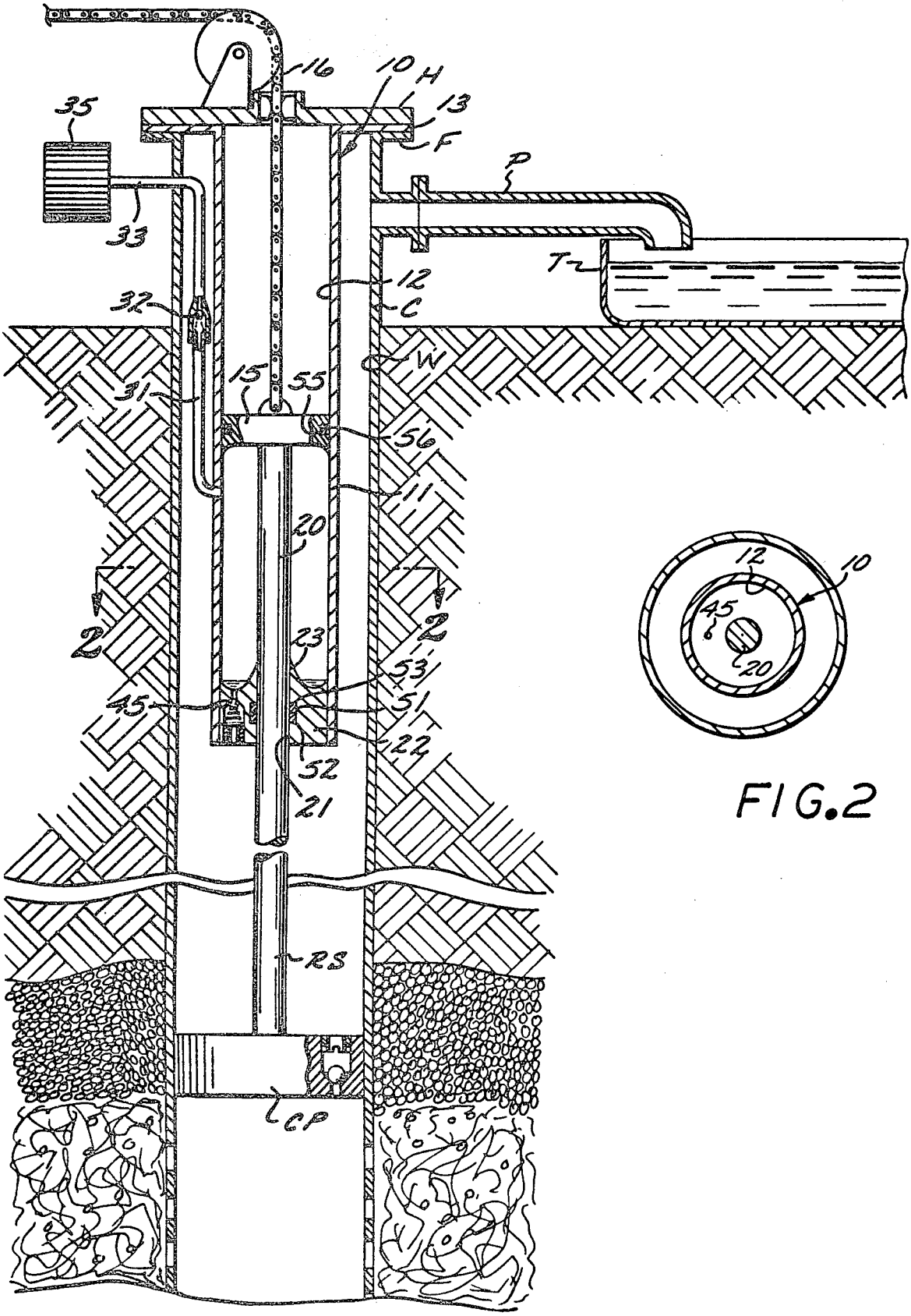
FIG. 1 is a side view in section of an oil well provided with the inventive downhole seal.
FIG. 2 is a sectional view, taken along line 2—2 of FIG. 1, illustrating the annular arrangement of the downhole seal.

As shown in FIGS. 1 and 2 a well bore W normally includes a well casing C terminating in a well head H which includes a pipeline P draining into a collection tank T. In conventional form the well head H includes a flange F and it is from this flange F that the inventive downhole sealing assembly, generally designated by the numeral 10 is suspended. More specifically, the downhole seal assembly 10 comprises a cylinder 11 having a polished interior surface 12 and a radially extending flange 13 at the upper end thereof. Flange 13 may be deployed on flange F and may be conventionally secured thereat by any securing structures. In this arrangement the cylinder 11 extends downwardly into the casing C, the cylinder being of a substantially smaller than the interior diameter of the casing. Thus, an annular passageway is formed around the cylinder 11 through which the fluids pumped out of the well may be conveyed into the pipeline P.

The interior surface 12 of the cylinder 11 may be conformed to receive a piston 15 which is connected for reciprocation at the upper surface to a chain or flexible cable 16. It is this chain or flexible cable 16 that provides the motive power for lifting fluid out of the well bore, it being intended that any reciprocal prime mover means be utilized for this purpose. At the lower surface piston 15 is attached to a polished rod 20 which is conformed to fit in an annular opening 21 provided in an annular plug 22 at the bottom of the cylinder 11. Plug 22 at its upper surface may be conformed as a toroid to extend a tapered conical lip 23 around the polished rod 20. It is within this toroidal surface that any fluid leaked through the gap between the polished rod 20 and the opening 21 is collected.

To allow for aspiration of the enlarged cavity produced on the interior of the cylinder during the upward stroke cylinder 11 communicates with a vent pipe 31 connected in series with a check valve 32 and yet another vent pipe 33. Vent pipe segment 33, in turn, connects to a filter assembly 35 at the ground surface. The bias of the check valve 32 is such that as the piston 15 is reciprocated upwardly ingestion of air into the cylinder cavity underneath the piston can occur. During the downward stroke or as the cavity volume below the piston 15 is decreased, check valve 32 is pushed closed and the pressure within the cavity increases. It is this pressure that is relieved through yet another check valve 45 installed in the annular plug 22 and biased to open on the downward part of the piston stroke. Check valve 45, as it is located, communicates with the trough formed on the upper surface of the annular plug 22 and will thus receive the collected leakage fluid lying thereon. In this manner air is constantly ingested into the piston cavity and is used in the course of the downward strokes to return any fluid leakage.

To further reduce the leakage and the contaminants brought up into the piston cavity the annular plug 22 may include a ringed groove 51 in the rod bore thereof. Located within this ring groove is a scraper ring 52 such as the ring sold under themodel designation TBOS by the Double Seal Ring Company, P.O. Box 566, Fort Worth, Texas. The same ring groove 51, above the scraper ring 52, may include a sealing ring 53 sold, once more, under the Model designation SB by the Double Seal Ring Company at the same address above. Thus rings 52 and 53 effect a substantially complete seal contact with the polished rods 20, limiting the ingestion of well fluids during the reciprocating stroke. Piston 15 may be similarly provided with a ring groove 55 around the periphery thereof, once more, sized to receive a commercially available ring assembly therein. For the purposes herein ring groove 55 is provided with a double ring assembly 56 sold under the model designation ACORN by the Double Seal Ring Company identified above. The foregoing arrangement of parts allows for a substantially leak-proof pumping arrangement which by virtue of the limited ring contact can operate at extremely high temperatures and pressures. Furthermore, in the event of exceptionally high pressure differentials between the interior of cylinder 11 and the well bore, it is possible to select compression levels and bias of check valve 45 to pump up the contained volume within the cylinder above the pressure of the well bore. Thus, effectively all or most of the contaminants heretofore encountered are kept out of the critical machine areas, the polished rod 20 connecting to a rod string RS which, in turn, drives a conventional pump CP.

Figure 3:
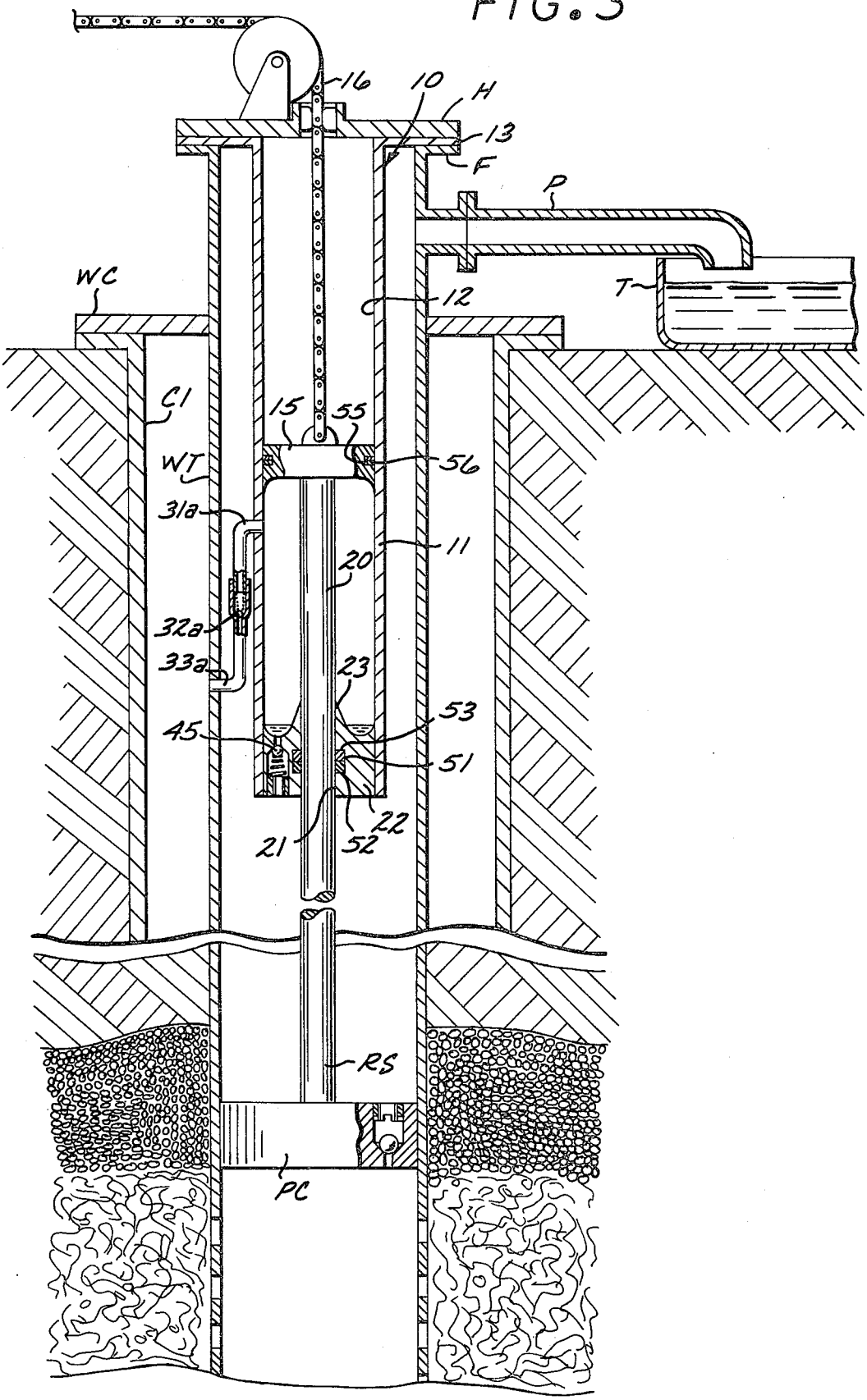
FIG. 3 is an alternative implementation of the downhole seal providing for the aspiration into the well casing.

While in the foregoing arrangement the well casing and the well tube are used interchangeably the annular gap therebetween conventionally found may be used to further advantage. Thus, as shown in FIG. 3, the aspiration path from the interior of the cylinder may extend into this annular gap, the aspirated gases thus being retained below ground. In this illustration the mechanical sealing arrangement remains the same and both the numerical part designations and functions are therefore retained according to the illustrations in FIGS. 1 and 2. In this figure, however, the well casing C1 surrounds a well tube WT. An aspiration conduit 31*a* then extends from the interior 12 to the exterior of the well tube terminating in an outlet 33*a*. It is this aspiration conduit 31*a* that now includes the check valve 32*a* providing the exact same function as previously set out. Since the gases within the casing C1 are now used to aspirate and since the well casing is sealed at the surface by a well cap WC the necessity for an air filter is obviated. In addition this aspiration arrangement insures that any fluid spillage in case of a check valve failure will be back into the casing, thus assuring a more environmentally acceptable structure.

Obviously many modifications and changes may be made to the foregoing description without departing from the spirit of the invention. It is therefore intended that the scope of the invention be determined solely on the claims appended hereto.

What is claimed is:

1. A downhole seal assembly conformed for suspension from a well head including a well casing and a well tubing annularly received therein and adapted to extend into the interior of said well casing comprising:

a cylinder including a flange on one end thereof adapted to attach to said well head and conformed to align said cylinder within said well;

a piston slidably received on the interior of said cylinder;

a rod connected to said piston and aligned to extend through said cylinder into said well;

an annular plug inserted in the other end of said cylinder including a central opening conformed to slideably receive said rod; and a check valve deployed in said plug and aligned to relieve said cylinder upon the downward translation of said piston.

2. Apparatus according to claim 1 wherein:

said piston includes sealing rings around the periphery thereof; and said plug includes sealing rings in the central opening thereof.

3. Apparatus according to claim 2 wherein:

said annular plug includes a dished interior surface arranged to be drained by said check valve.

* * * * *